US012022951B2

(12) United States Patent
Lu

(10) Patent No.: US 12,022,951 B2
(45) Date of Patent: Jul. 2, 2024

(54) FOLDING CHAIR DEVICE

(71) Applicant: Dongguan Weihong Smart Home Technology Co., Ltd., Guangdong (CN)

(72) Inventor: Wei Lu, Guangdong (CN)

(73) Assignee: DONGGUAN WEIHONG SMART HOME TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/821,504

(22) Filed: Aug. 23, 2022

(65) Prior Publication Data

US 2023/0200534 A1 Jun. 29, 2023

(30) Foreign Application Priority Data

Dec. 28, 2021 (CN) ..... 202123364095.X
Aug. 2, 2022 (CN) ..... 202222022368.0

(51) Int. Cl.
*A47C 1/037* (2006.01)
*A47C 1/032* (2006.01)

(52) U.S. Cl.
CPC ..... *A47C 1/037* (2013.01); *A47C 1/03255* (2013.01)

(58) Field of Classification Search
CPC ..... A47C 1/037; A47C 1/03255
USPC ..... 297/85 M, 423.36, 408
See application file for complete search history.

(56) References Cited

U.S. PATENT DOCUMENTS 3,537,749 A * 11/1970 Putsch ..... B60N 2/853 297/362
5,651,587 A * 7/1997 Kodaverdian ..... B60N 2/0228 297/423.36
6,695,406 B2 * 2/2004 Plant ..... B64D 11/064 297/423.34
2004/0012231 A1 * 1/2004 Hesse ..... A47C 1/0355 297/85 M

FOREIGN PATENT DOCUMENTS

CN 216454225 U 5/2022
CN 216494448 U 5/2022

* cited by examiner

*Primary Examiner* — Milton Nelson, Jr.
(74) *Attorney, Agent, or Firm* — SHIMOKAJI IP

(57) ABSTRACT

A folding chair device of the present invention includes a seat support assembly, a backrest assembly, a leg rest assembly, a backrest driving device, a connecting rod assembly and a leg rest driving device. A bottom of the backrest assembly is pivotally connected with the seat support assembly, the backrest driving device is pivotally connected with the backrest assembly; the leg rest assembly is pivotally connected with the seat support assembly, the leg rest driving device is mounted on the seat support assembly, and the connecting rod assembly is connected with a driving end of the leg rest driving device and pivotally connected with the leg rest assembly. The inclination angle of multiple assemblies of the device can be adjusted, and the device has a simple structure and low production cost, which is suitable for popularization in industry and daily life.

17 Claims, 14 Drawing Sheets

FOLDING CHAIR DEVICE

FIELD OF THE INVENTION

The invention relates to the field of furniture, in particular to folding chair devices that can be adjusted automatically.

BACKGROUND OF THE INVENTION

Folding chairs or folding sofas are common furniture. However, the existing common folding chair devices are mainly folded manually, which are very inconvenient to operate, and the personalized functions are not perfect enough to meet the needs of users. At present, some electric folding chair devices have been promoted one after another, but the overall structure of the frame for the existing electric folding chair device is complicated, to lead to a large production cost is also very large, which cannot meet the existing production needs apparently.

To solve the above problems, it is necessary to provide an improved folding chair device.

SUMMARY OF THE INVENTION

The purpose of the present invention is to provide an improved folding chair device, in which the inclination angle of multiple assemblies of the frame can be adjusted to meet the diverse needs of the users, and the device has a simple structure and low production cost, which is suitable for popularization in industry and daily life.

As a first aspect, a folding chair device of the present invention includes a seat support assembly, a backrest assembly, a leg rest assembly, a backrest driving device, a connecting rod assembly and a leg rest driving device, wherein a bottom of the backrest assembly is pivotally connected with the seat support assembly, the backrest driving device is configured between the seat support assembly and the backrest assembly, the backrest driving device is pivotally connected with the backrest assembly, and the backrest driving device is driven to pivot relative to the seat support assembly under a driving motion of the backrest driving device thereby adjust an inclination angle of the backrest assembly; the leg rest assembly is pivotally connected with the seat support assembly, the leg rest driving device is mounted on the seat support assembly, and the connecting rod assembly is connected with a driving end of the leg rest driving device and pivotally connected with the leg rest assembly, and the connecting rod assembly is driven to actuate the leg rest assembly to pivot relative to the seat support assembly under a driving motion of the leg rest driving device thereby adjusting an inclination angle of the leg rest assembly.

Preferably, a lower part of the backrest assembly is extended toward the seat support assembly to form a first connecting member, a bottom of the backrest assembly is extended toward the backrest driving device to form a second connecting member, and a driving end of the backrest driving device is connected to the seat support assembly, a head of the backrest driving device is pivotally connected to the second connecting member, and the first connecting member is pivotally connected to the seat support assembly.

Preferably, the seat support assembly is extended toward the backrest driving device to form an installation frame, the installation frame comprises an installation crossbar and an installation horizontal rod perpendicular to the installation crossbar, one end of the installation crossbar is connected to the seat support assembly, and the other end of the installation crossbar is connected with one end of the installation horizontal rod, the other end of the installation horizontal rod is connected with the seat support assembly, and the driving end of the backrest driving device is connected with the installation horizontal rod.

Preferably, the connecting rod assembly comprises a driving crossbar and a first connecting rod, the driving crossbar is pivotally connected with the driving end of the leg rest driving device, one end of the first connecting rod is pivotally connected with the driving crossbar, the other end of the first connecting rod is pivotally connected with the leg rest assembly, and the driving crossbar moves relative to the seat support assembly under a driving motion of the leg rest driving device and causes the first connecting rod to drive the leg rest assembly to swing.

Preferably, the device further includes a guide assembly including a first swing rod, a moving rod and a second swing rod, one end of the first swing rod is pivotally connected to the seat support assembly, and the other end of the first swing rod is pivotally connected to one end of the moving rod, the other end of the moving rod is pivotally connected to one end of the second swing rod, the other end of the second swing rod is pivotally connected to the seat support assembly, and the first swing rod, the moving rod, the second swing rod and the seat support assembly together form a four-bar linkage mechanism, the driving crossbar is connected with the moving rod, and the driving crossbar is movable relative to the seat support assembly to cause to unfold or fold the four-bar linkage mechanism.

Preferably, the device further includes a headrest assembly pivotally connected with the backrest assembly and having an adjustable inclination angle relative to the backrest assembly.

Preferably, the device further includes a headrest driving device, wherein a driving end of the headrest driving device is connected with the headrest assembly, and the headrest assembly is driven to rotate relative to the backrest assembly due to an automatic driving motion of the headrest driving device.

Preferably, the device further includes a hinge arranged between the headrest assembly and the backrest assembly, wherein the hinge includes a first hinge part and a second hinge part that are pivotally connected to each other, and the first hinge part is connected with the headrest assembly, the second hinge part is connected with the backrest assembly, and an inclination angle of the headrest assembly relative to the backrest assembly is adjustable by manually operating the hinge.

In comparison with the prior arts, in the present invention, the seat support assembly, the backrest assembly, the leg rest assembly, the backrest driving device, the connecting rod assembly and the leg driving device are combined together. Specifically, the backrest driving device is pivotally connected with the backrest assembly, and the backrest assembly is driven to pivot relative to the seat support assembly around its pivot point under a driving motion of the backrest driving device, thereby unfolding or folding the backrest assembly. That is, the backrest driving device, the backrest assembly and the seat support assembly together form a linkage structure, and backrest assembly is rotatable relative to the seat support assembly due to the electric motions of the backrest driving device, thereby realizing the adjustment of the inclination angle of the backrest assembly, which leads to a simple structure and a low cost. The leg rest assembly is pivotally connected to the seat support assembly, and the leg rest assembly is rotatable relative to the seat support assembly thereby realizing the unfolding or folding of the leg rest assembly. The leg rest driving device is mounted on the seat support assembly, the connecting rod assembly is connected with the driving end of the leg rest driving device and pivotally connected with the leg rest assembly, in such a way, the connecting rod assembly is driven to actuate the leg rest assembly to pivot relative to the seat support assembly around its pivot point under a driving motion of the leg rest driving device thereby unfolding or folding the leg rest assembly. That is to say, the connecting rod assembly is served as a power transmission assembly between the leg rest assembly and the leg rest driving device, so that the leg rest assembly can be automatically pivoted relative to the seat support assembly, so as to realize the automatic folding or unfolding of the leg rest assembly. By this token, the inclination angles of the backrest assembly and the leg rest assembly also can be adjusted automatically. The device is multifunctional, and has simple structure and low production cost, which is suitable for popularization in industry and daily life.

DETAILED DESCRIPTION OF ILLUSTRATED EMBODIMENTS

Figure 1:
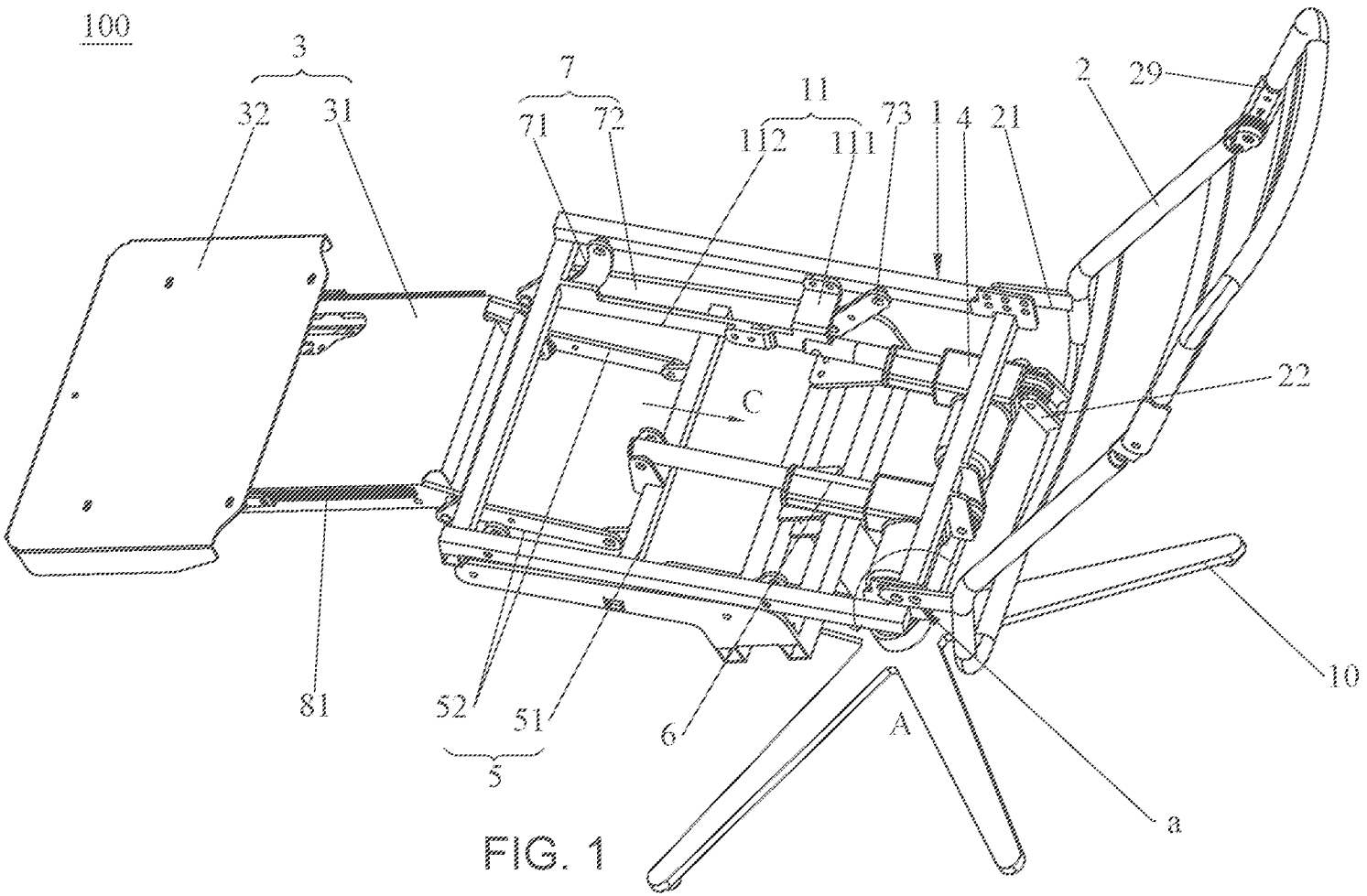
FIG. 1 is a perspective view of the folding chair device according to a first embodiment of the present invention in an unfolded state.

In order to make the purpose, technical solutions and advantages of the present application more clearly understood, the present application will be described in further detail below with reference to the accompanying drawings and embodiments. It should be understood that the specific embodiments described herein are only used to explain the present application, but not to limit the present application. The same reference numbers in different figures represent the same parts.

As described above, the essence of the present invention is to provide a folding chair device, which has advantages of multiple functions, simple structure and low production cost.

It should be noted that the inclination angle of the corresponding foldable assembly involved in the folding chair device of the present invention can be automatically adjusted according to actual needs, which is not limited to two states of unfolding and folding as shown the following embodiments, for example.

Referring to FIGS. 1-5, a folding chair device according to a first embodiment of the present invention is shown. The folding chair device 100 includes a seat support assembly 1, a backrest assembly 2, a leg rest assembly 3, a backrest driving device 4, a connecting rod assembly 5 and a leg rest driving device 6. Specifically, the bottom of the seat support assembly 1 is provided with a supporting foot 10 for moving, and the seat support assembly 1 is a rectangular frame structure. The bottom of the backrest assembly 2 is pivotally connected to the seat support assembly 1. The backrest driving device 4 is arranged between the seat support assembly 1 and the backrest assembly 2. In the meantime, the backrest driving device 4 is pivotally connected with the backrest assembly 2, and the backrest assembly 2 is driven to pivot relative to the seat support assembly 1 around its pivot point labeled as a in the FIG. 1, under a driving motion of the backrest driving device, thereby adjusting the inclination angle of the backrest assembly 2, for example, unfolding or folding the backrest assembly 2. It can be seen that the backrest driving device 4, the backrest assembly 2 and the seat support assembly 1 together form a linkage structure, and the backrest assembly 2 is rotatable relative to the seat support assembly 1 under the automatic driving motions of the backrest driving device 4, thereby realizing the adjustment of the inclination angle of the backrest assembly 2, which leads to a simple structure and a low cost. The leg rest assembly 3 is pivotally connected to the seat support assembly 1 (the pivot point is labeled as b in FIG. 2), and the leg rest assembly 3 is rotatable relative to the seat support assembly 1 thereby realizing the adjustment of the inclination angle of the leg rest assembly 3, such as unfolding or folding.

The leg rest driving device 6 is mounted on the seat support assembly 1, the connecting rod assembly 5 is connected with a driving end of the leg rest driving device 6 and pivotally connected with the leg rest assembly 3, in such a way, the connecting rod assembly 5 is driven to actuate the leg rest assembly 3 to pivot relative to the seat support assembly 1 around its pivot point under a driving motion of the leg rest driving device 6 thereby unfolding or folding the leg rest assembly 3. It can be seen that the connecting rod assembly 5 is served as a power transmission assembly between the leg rest assembly 3 and the leg rest driving device 6, so that the leg rest assembly 3 can be automatically pivoted relative to the seat support assembly 1, so as to realize the automatic folding or unfolding of the leg rest assembly 3. Preferably, the backrest driving device 4 and the leg rest driving device 6 are both drive motors, such as electric push rods, and the driving end of the drive motor has a retractable push rod, thereby realizing electric driving.

Figure 2:
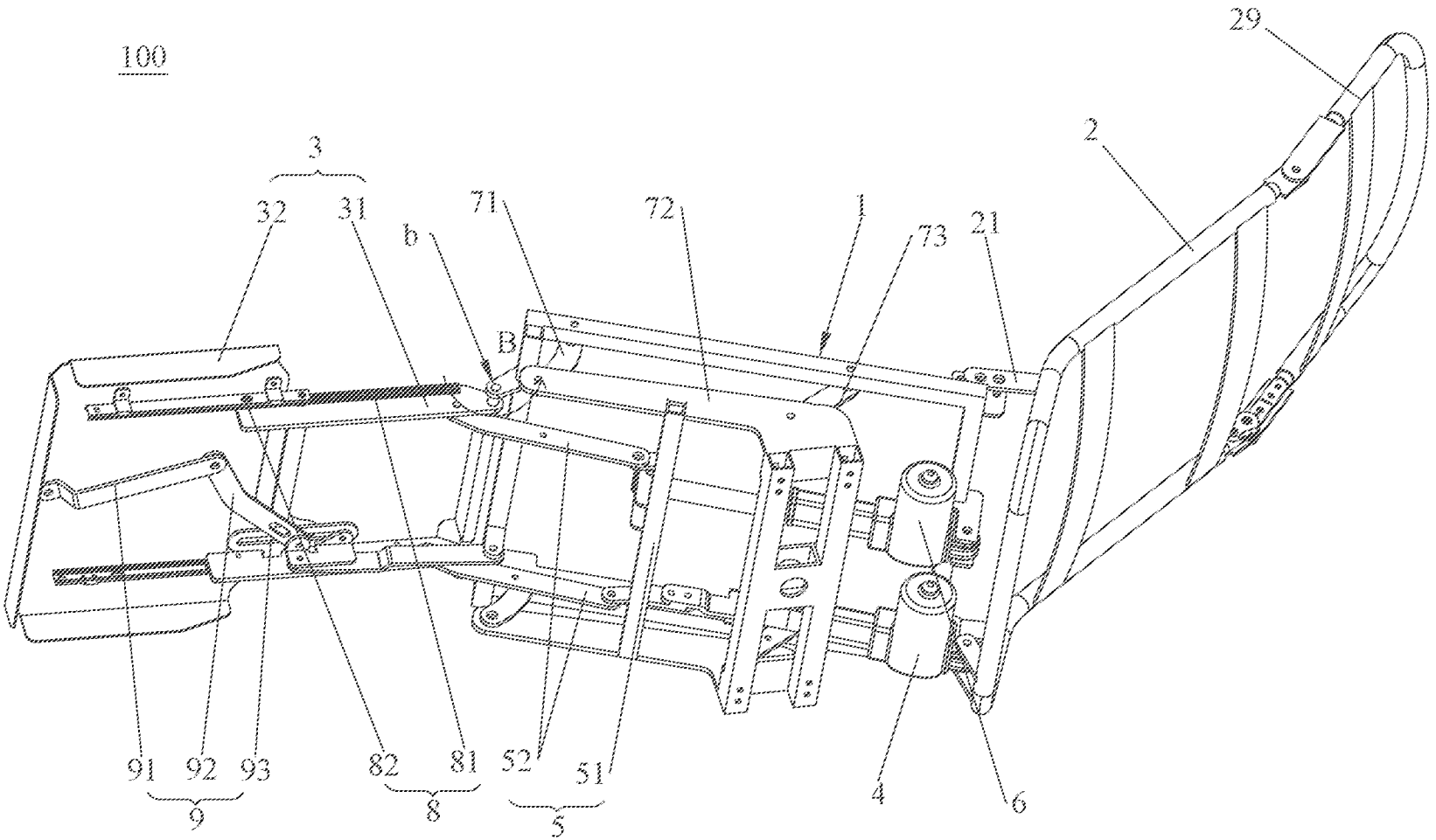
FIG. 2 is a partial perspective view of the folding chair device according to the first embodiment of the present invention in the unfolded state.

More specifically, referring to FIGS. 1-2, a lower part of the backrest assembly 2 is extended toward the seat support assembly 1 to form a first connecting member 21, and a bottom of the backrest assembly 2 is extended toward the backrest driving device 4 to form a second connecting member 22. Both of the first connecting member 21 and the second connecting member 22 are for connecting, and the first connecting member 21 is located above the second connecting member 22. The driving end of the backrest driving device 4 is connected with the seat support assembly 1, and a head of the backrest driving device 4 is pivotally connected to the second connecting member 22, and the first connecting member 21 is pivotally connected to the seat support assembly 1. Specifically, the seat support assembly 1 is extended toward the backrest driving device 4 to form an installation frame 11. The installation frame 11 includes an installation crossbar 111 and an installation horizontal rod 112 perpendicular to the installation crossbar, one end of the installation crossbar 111 is connected to the seat support assembly 1, and the other end of the installation crossbar 111 is connected with one end of the installation horizontal rod 112, the other end of the installation horizontal rod 112 is connected with the seat support assembly 1, and the driving end of the backrest driving device 4 is connected with the installation horizontal rod 112. The installation frame 11 can be extended so as to facilitate the connection of the backrest driving device 4, and the installation frame 11 and the seat support assembly 1 together form a small rectangular frame structure.

Figure 3:
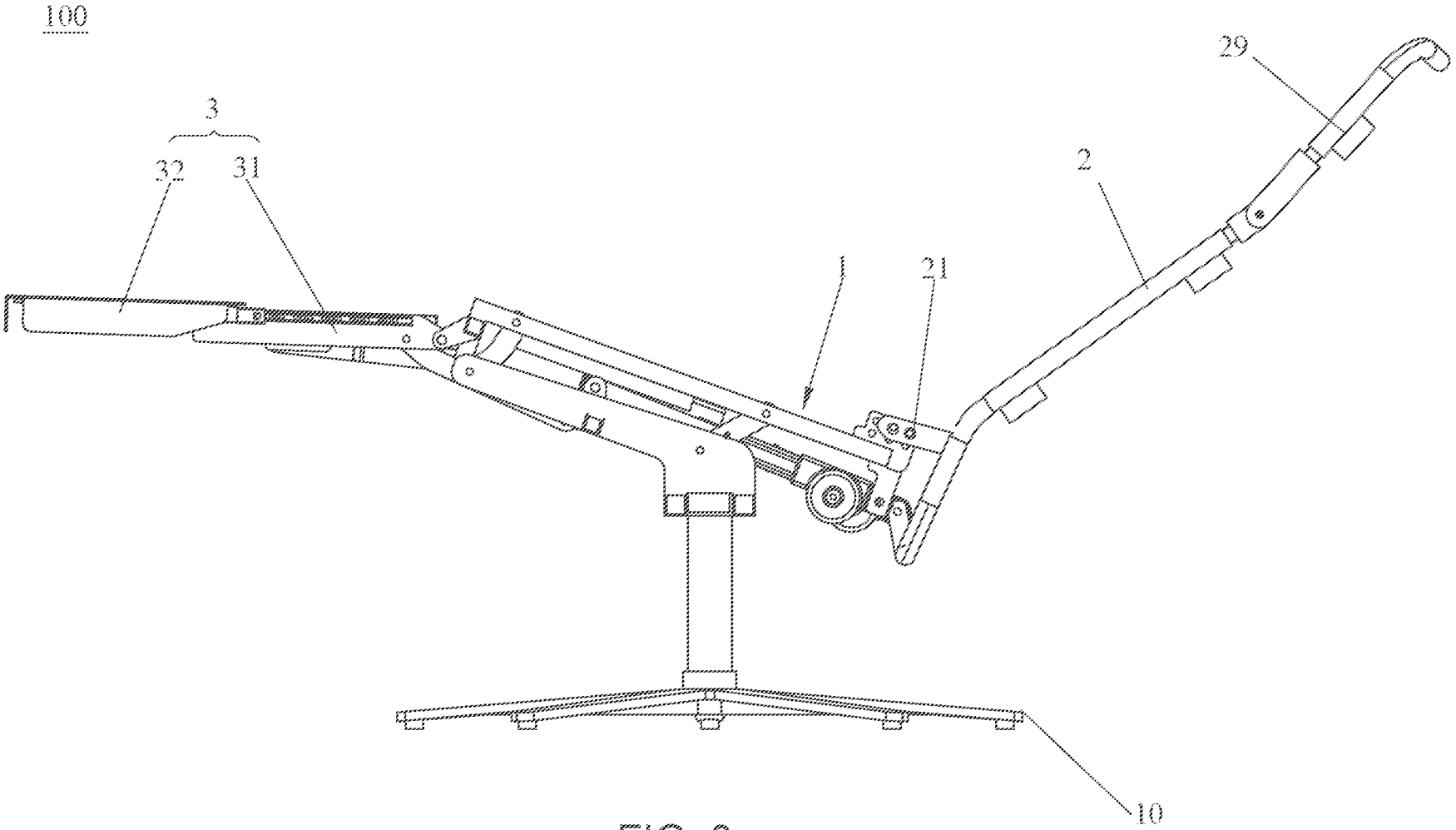
FIG. 3 is a side view of the folding chair device according to the first embodiment of the present invention in the unfolded state.

Referring to FIGS. 1-3, the connecting rod assembly 5 includes a driving crossbar 51 and a first connecting rod 52, the driving crossbar 51 is pivotally connected with the driving end of the leg rest driving device 6, one end of the first connecting rod 52 is pivotally connected with the driving crossbar 51, the other end of the first connecting rod 51 is pivotally connected with the leg support assembly 3, and the driving crossbar 51 moves relative to the seat support assembly 1 under the driving motion of the leg rest driving device 6 and causes the first connecting rod 51 to drive the leg rest assembly 3 to swing. Specifically, the folding chair device 100 of the present invention further includes a guide assembly 7 including a first swing rod 71, a moving rod 72 and a second swing rod 73. More specifically, one end of the first swing rod 71 is pivotally connected to the seat support assembly 1, and the other end of the first swing rod 71 is pivotally connected to one end of the moving rod 72, the other end of the moving rod 72 is pivotally connected to one end of the second swing rod 73, and the other end of the second swing rod 73 is pivotally connected to the seat support assembly 1. The first swing rod 71, the moving rod 72, the second swing rod 73 and the seat support assembly 1 together form a four-bar linkage mechanism, the driving crossbar 51 is connected with the moving rod 72, and the driving crossbar 51 is movable relative to the seat support assembly 1 to unfold or fold the four-bar linkage mechanism. Preferably, both sides of the driving crossbar 51 are connected with one said four-bar linkage mechanism. In other words, the formed four-bar linkage mechanism is not only for connecting between the seat support assembly 1 and the driving crossbar 51, but also guiding the movement of the driving crossbar 51, so that the movement of the driving crossbar 51 relative to the seat support assembly 1 can be more stable and smooth.

Referring to FIGS. 1-2, the leg rest assembly 3 includes a fixed frame 31 and a movable frame 32. The fixed frame 31 is pivotally connected to the seat support assembly 1, the movable frame 32 is slidably configured on the fixed frame 31, and the movable frame 32 is movable relative to the fixed frame 31 to unfold or fold the leg rest assembly 3. The leg rest assembly 3 further includes a guide rail assembly 8 arranged between the fixed frame 31 and the movable frame 32. The guide rail assembly 8 includes an inner rail 81 and an outer rail 82. One of the inner rail 81 and the outer rail 82 is connected to the fixed frame 31, the other of the inner rail 81 and the outer rail 82 is connected with the movable frame 32, and the inner rail 81 is slidably arranged on the outer rail 82. The leg rest assembly 3 further includes a sliding locking mechanism 9 including a first pivoting rod 91, a second pivoting rod 92 and a locking member 93. One end of the first pivoting rod 91 is pivotally connected with the movable frame 32, one end of the second pivoting rod 92 is pivotally connected with the other end of the first pivoting rod 91, and the other end of the second pivoting rod 92 is connected with the locking member 93, in such a way, the pivoting motion between the first pivoting rod 91 and the second pivoting rod 92 is locked by the locking member 93. Optionally, the locking member 93 may have several engaging grooves, which is depended on actual demands of the manufacturer.

Referring to FIGS. 1-5, the folding chair device 100 further includes a headrest assembly 29 pivotally connected with the backrest assembly 2 and having an adjustable inclination angle relative to the backrest assembly 2. For example, a rotation mechanism (not shown in the figure), such as a hinge is provided between the headrest assembly 29 and the backrest assembly 2, through which the inclination angle of the headrest assembly 29 relative to the backrest assembly 2 is manually adjusted.

Figure 6:
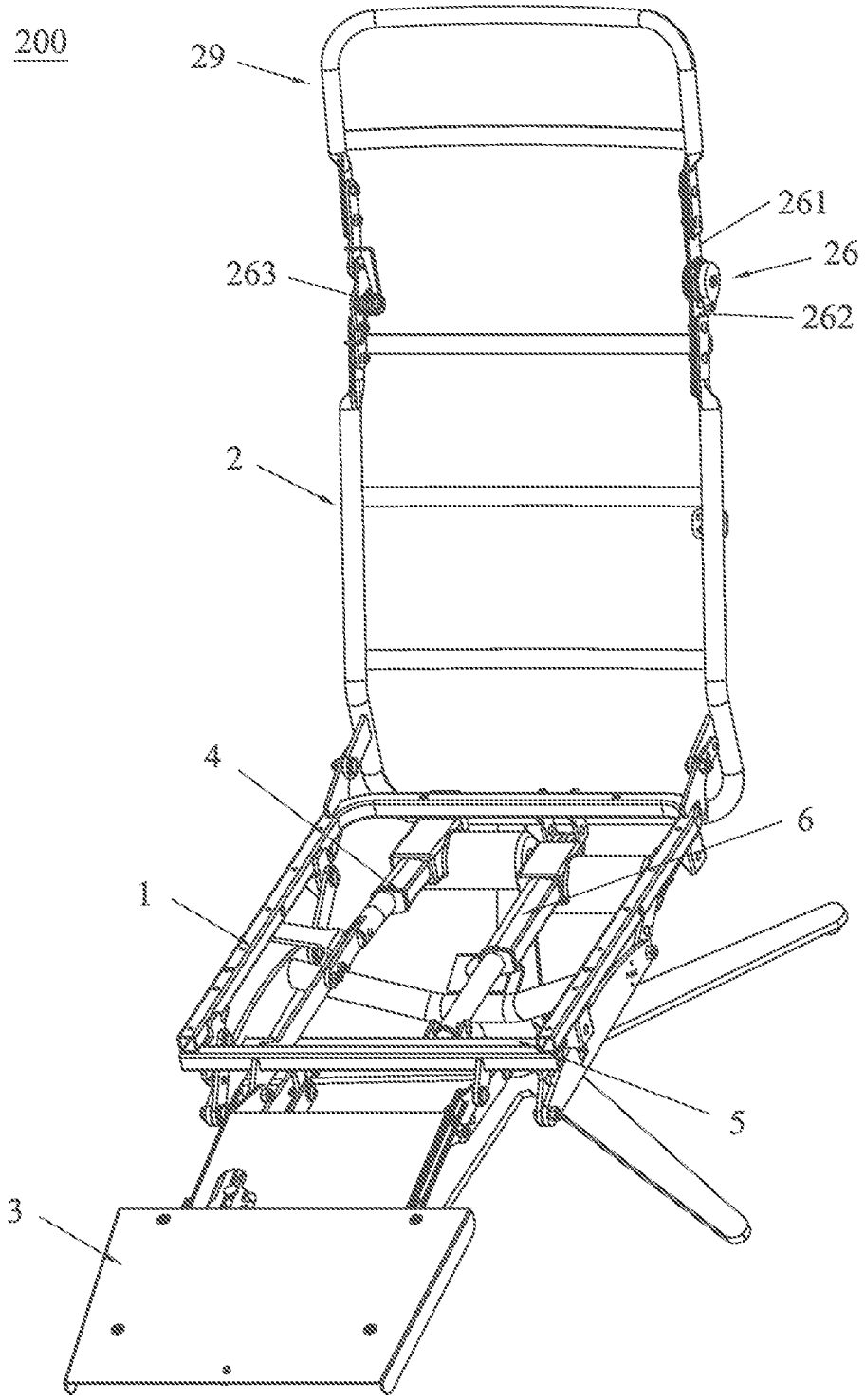
FIG. 6 is a perspective view of the folding chair device according to a second embodiment of the present invention in the unfolded state.
Figure 7:
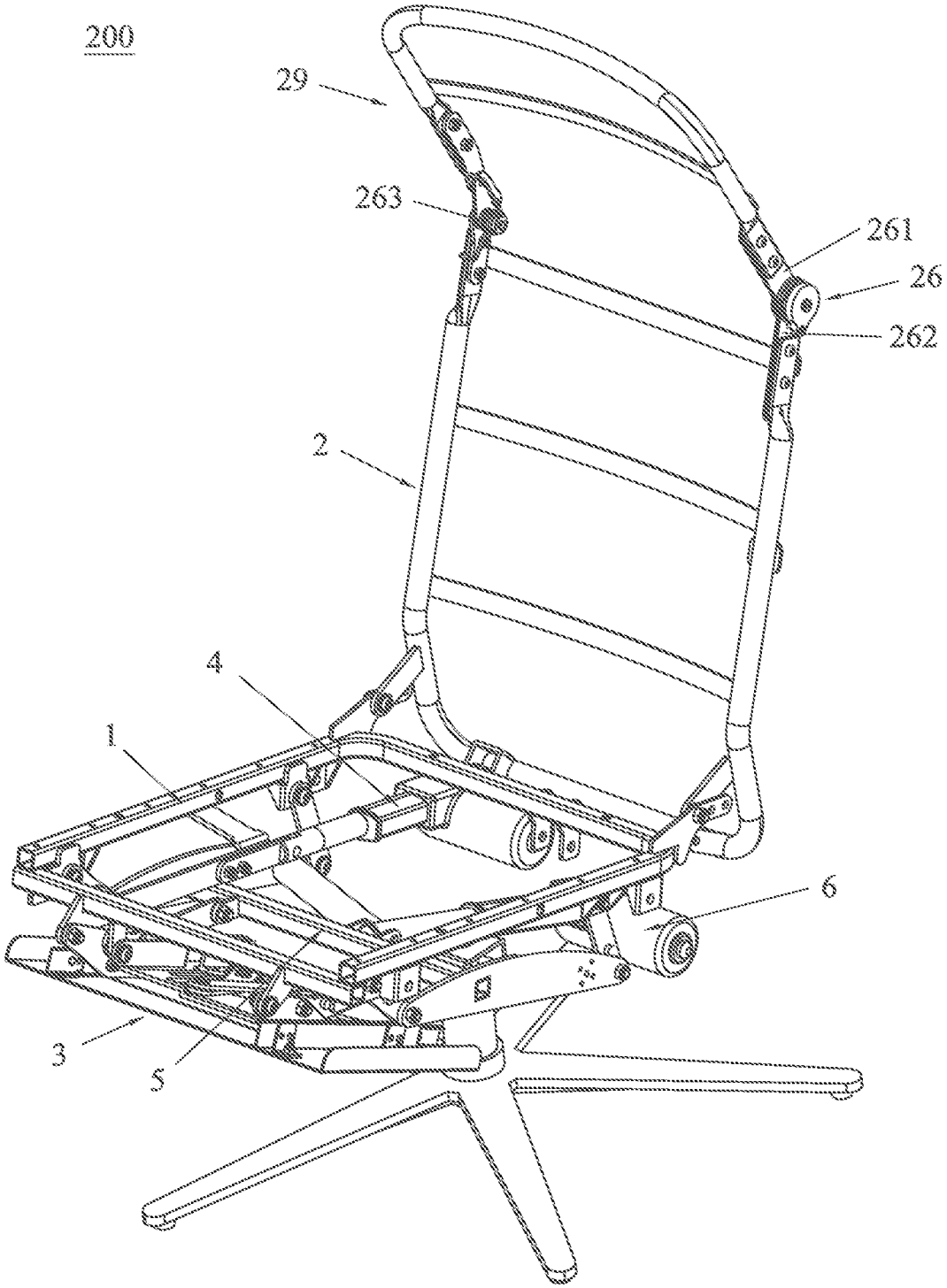
FIG. 7 is a perspective view of the folding chair device according to the second embodiment of the present invention in the folded state.

FIGS. 6-7 show a folding chair device 200 according to a second embodiment, which show the rotation mechanism between the headrest assembly 29 and the backrest assembly 2 in details, to achieve a manual adjustment. As illustrated, a hinge 26 is configured between the headrest assembly 29 and the backrest assembly 2, which includes a first hinge part 261 and a second hinge part 262 that are pivotally connected to each other, and the first hinge part 261 is connected with the headrest assembly 29, the second hinge part 262 is connected with the backrest assembly 2, and the inclination angle of the headrest assembly 29 relative to the backrest assembly 2 is adjustable by manually operating the hinge 26. More specifically, the hinge 26 can be provided at only one side of the headrest assembly 29, and the headrest assembly 29 at other side is pivotally connected to the backrest assembly 2 through a conventional pivoting member, and preferably, a torsion spring 263 can be provided at other side to eliminate the gap existing in the hinged components and ensure the elastic stability between the components during the movement.

Referring to FIG. 1 to FIG. 5, the working process of the folding chair device 100 of the present invention follows, for a detailed description.

Figure 4:
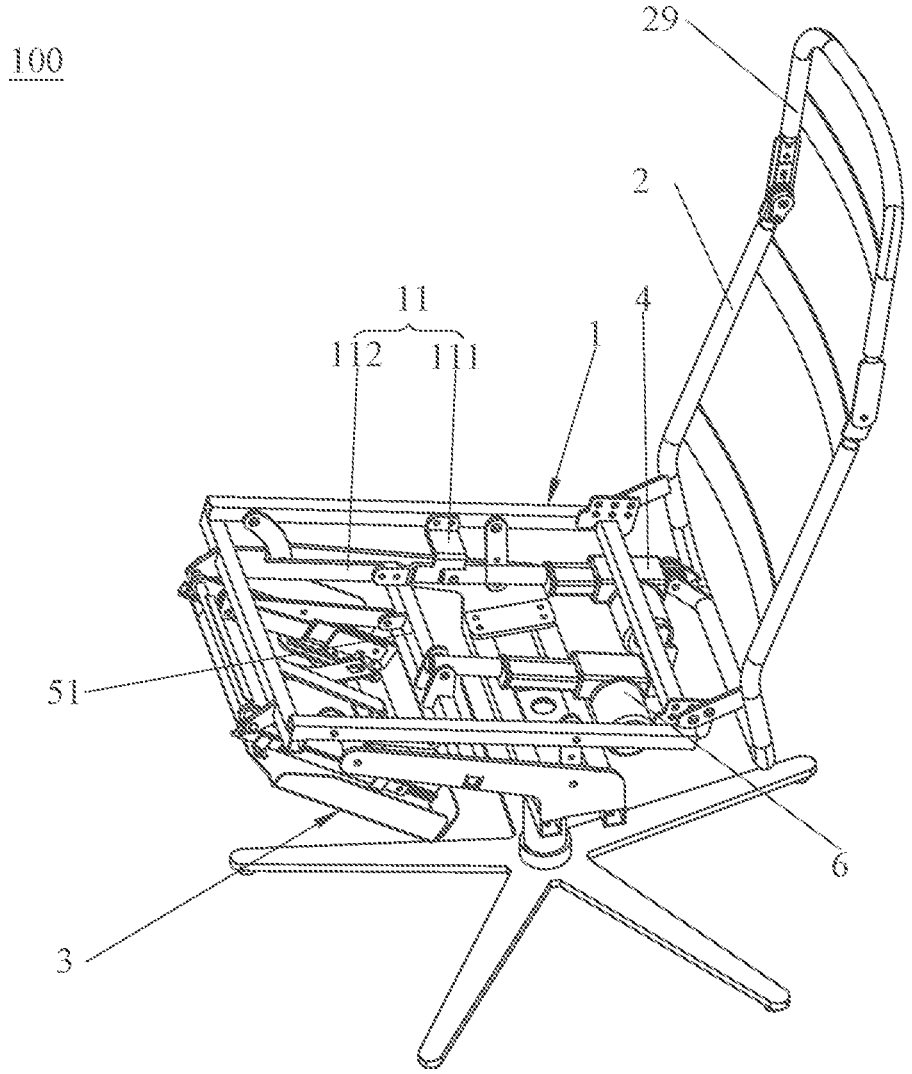
FIG. 4 is a perspective view of the folding chair device according to the first embodiment of the present invention in a folded state.
Figure 5:
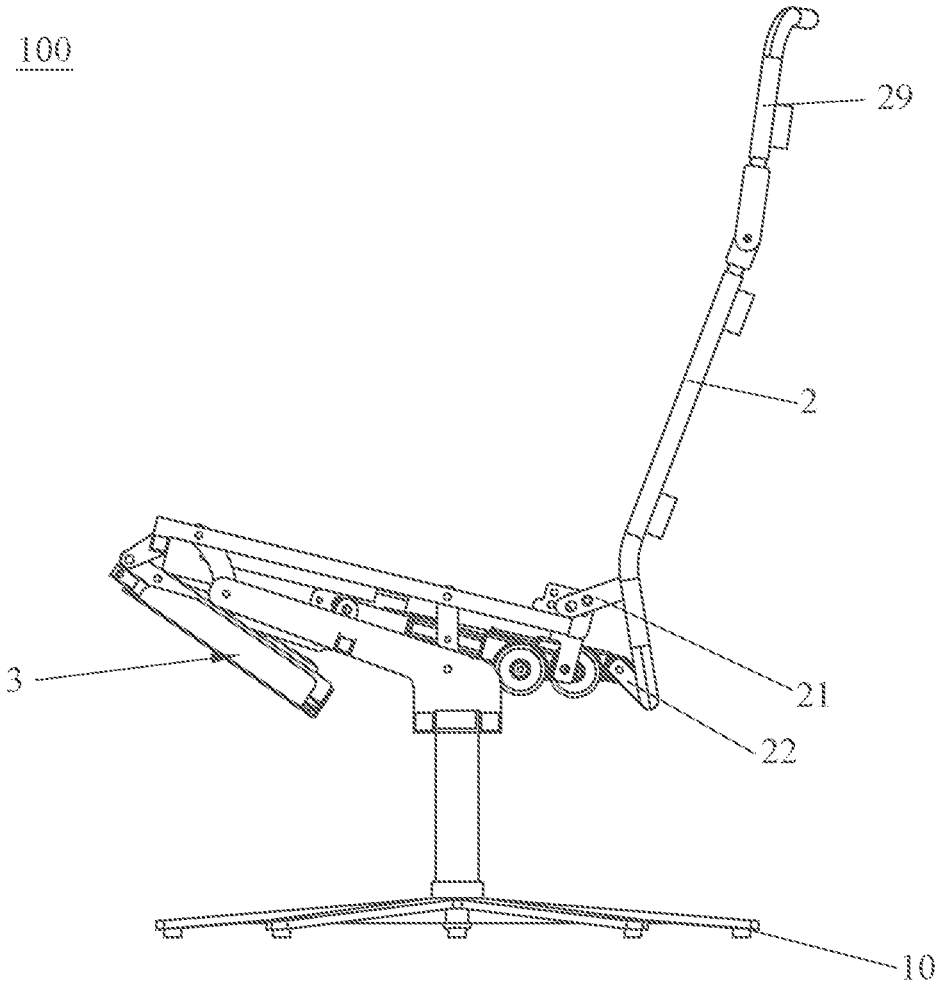
FIG. 5 is a side view of the folding chair device according to the first embodiment of the present invention in the folded state.

As shown in FIGS. 1 to 3, the folding chair device 100 is in the unfolded state. When there is a need to fold, the driving end of the backrest driving device 4 is extended out, causing the backrest assembly 2 rotate around its pivot point a relative to the seat support assembly 1 (the rotation direction is indicated by arrow A in FIG. 1), so that the backrest assembly 2 is folded relative to the seat support assembly 1 to a certain degree. At the same time, the driving end of the leg rest driving device 6 is retracted. Since the driving crossbar 51, the first connecting rod 52, the leg rest assembly 3, the leg rest driving device 6 and the seat support assembly 1 together form the linkage mechanism, and a pivot point b is formed between the leg rest assembly 3 and the seat support assembly 1, thus the driving crossbar 51 moves along the direction indicated as arrow C in FIG. 1 and causes the first connecting rod 52 to drive the leg rest assembly 3 to pivot around its pivot point b relative to the seat support assembly 1 (the rotation direction is indicated by arrow B in FIG. 1), so that the leg rest assembly 3 can be folded, as shown in FIGS. 4 and 5. The movable frame 32 moves relative to the fixed frame 31 through the guide rail assembly 8, so that the leg rest assembly 3 can be extended or retracted. The inclination angle of the headrest assembly 29 may be adjusted manually according to the actual demands, for example unfolding as shown in FIG. 6 and folding as shown in FIG. 7. When there is a need to unfold the device 100, the above actions are to be operated in reverse.

To sum up, in the present invention, the seat support assembly 1, the backrest assembly 2, the leg rest assembly 3, the backrest driving device 4, the connecting rod assembly 5 and the leg driving device 6 are combined together. Specifically, the backrest driving device 4 is pivotally connected with the backrest assembly 2, and the backrest assembly 2 is driven to pivot relative to the seat support assembly 1 around its pivot point under a driving motion of the backrest driving device 4, thereby unfolding or folding the backrest assembly 2. That is, the backrest driving device 4, the backrest assembly 2 and the seat support assembly 1 together form a linkage structure, and backrest assembly 2 is rotatable relative to the seat support assembly 1 due to the electric motions of the backrest driving device 4, thereby realizing the adjustment of the inclination angle of the backrest assembly 2, which leads to a simple structure and a low cost. The leg rest assembly 3 is pivotally connected to the seat support assembly 1, and the leg rest assembly 3 is rotatable relative to the seat support assembly 1 thereby realizing the unfolding or folding of the leg rest assembly 3. The leg rest driving device 6 is mounted on the seat support assembly 1, the connecting rod assembly 5 is connected with the driving end of the leg rest driving device 6 and pivotally connected with the leg rest assembly 3, in such a way, the connecting rod assembly 5 is driven to actuate the leg rest assembly 3 to pivot relative to the seat support assembly 1 around its pivot point under a driving motion of the leg rest driving device 6 thereby unfolding or folding the leg rest assembly 3. That is to say, the connecting rod assembly 5 is served as a power transmission assembly between the leg rest assembly 3 and the leg rest driving device 6, so that the leg rest assembly 3 can be automatically pivoted relative to the seat support assembly 1, so as to realize the automatic folding or unfolding of the leg rest assembly 3. Furthermore, the inclination angle of the headrest assembly 29 can be manually adjusted to a desired position to meet the user's demand.

FIGS. 8-13 show a folding chair device 300 according to a third embodiment of the present invention. The basic frame structure of the folding chair device 300 is substantially the same as the above embodiments, except for the adjustment of the headrest assembly 29. In this embodiment, the inclination angle of the headrest assembly 29 can be electrically adjusted by a headrest driving device instead of manually adjusted, which facilitates the operating, fits the user better, and improves the user experience.

Figure 8:
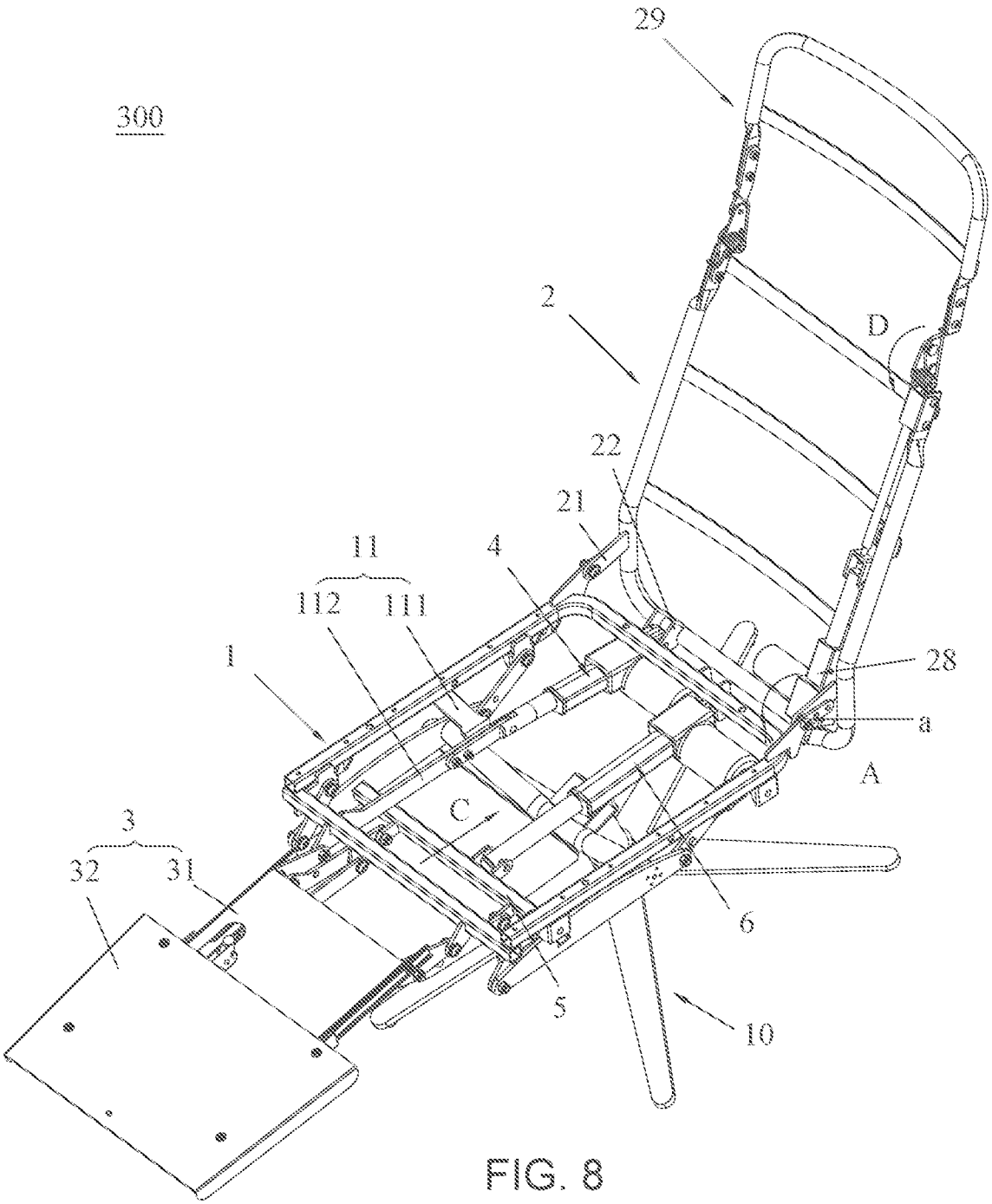
FIG. 8 is a perspective view of the folding chair device according to a third embodiment of the present invention in the unfolded state.

More specifically, as shown in FIG. 8, the folding chair device 300 includes a seat support assembly 1, a backrest assembly 2, a leg rest assembly 3, a backrest driving device 4, a connecting rod assembly 5, a leg rest driving device 6, a headrest assembly 29 and a headrest driving device 28. Specifically, the leg rest assembly 3 is pivotally connected to the seat support assembly 1 and is foldable relative to the seat support assembly 1, the backrest assembly 2 is pivotally connected to the seat support assembly 1 and has an adjustable inclination angle relative to the seat support assembly 1, and the headrest assembly 29 is pivotally connected to the backrest assembly 2 and has an adjustable inclination angle relative to the backrest assembly 2. The driving end of the headrest driving device 28 is connected to the headrest assembly 29, and the headrest assembly 29 is driven to rotate relative to the backrest assembly 2 by the automatic motions (extending or retracting) of the headrest driving device 28. The leg rest assembly 3, the backrest assembly 2, and the headrest assembly 29 of the folding chair device 300 can all be folded. Furthermore, the headrest assembly 29 can be automatically adjusted for angle adjustment or unfolding and folding operations. The device 300 has advantages of simple structure, low cost and improved user experience.

Figure 9A:
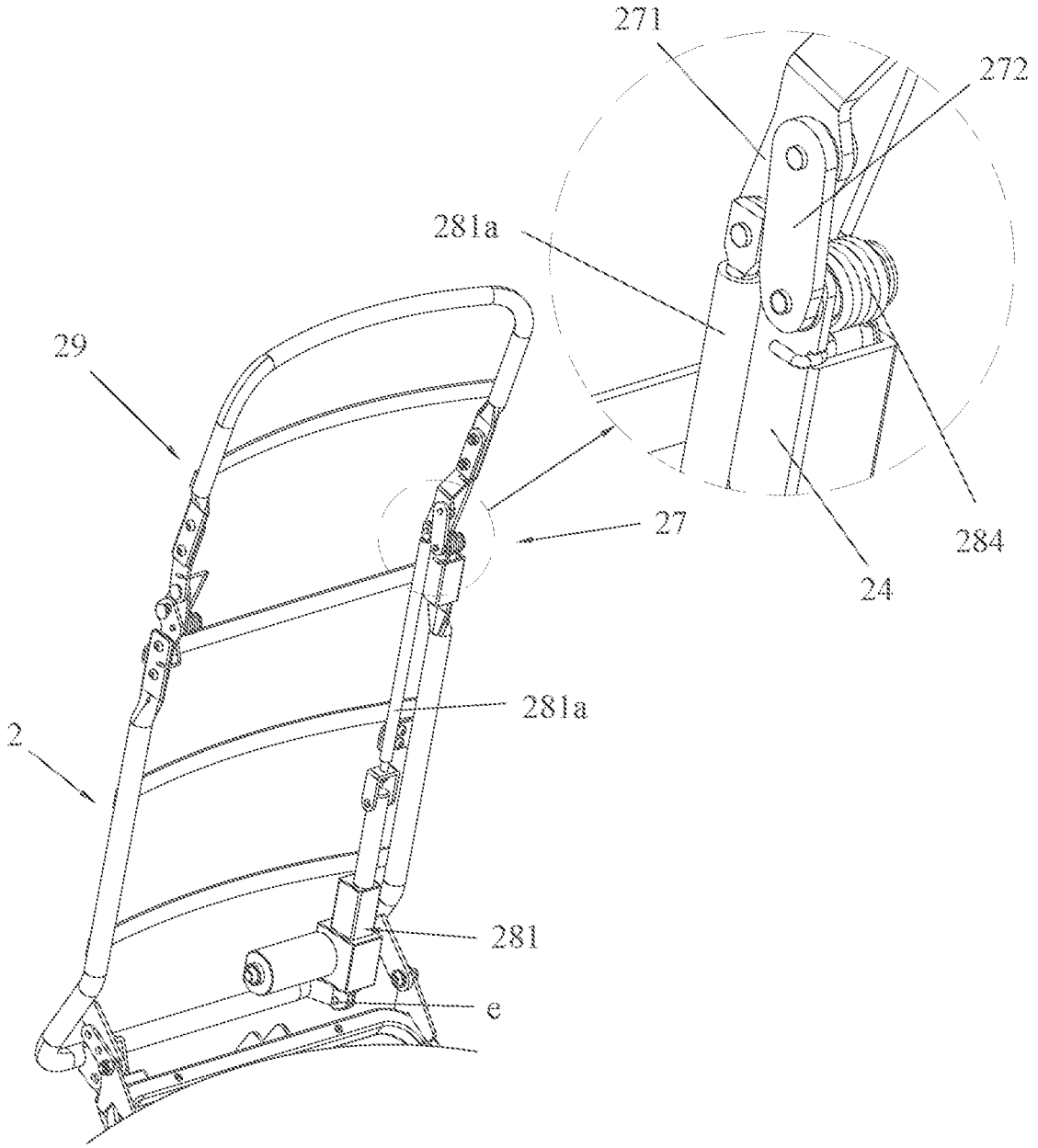
FIG. 9*a* is a partial perspective view and a partial enlarged view of the folding chair device according to the third embodiment of the present invention in the unfolded state, showing the backrest assembly, the headrest assembly and the headrest driving device.
Figure 9B:
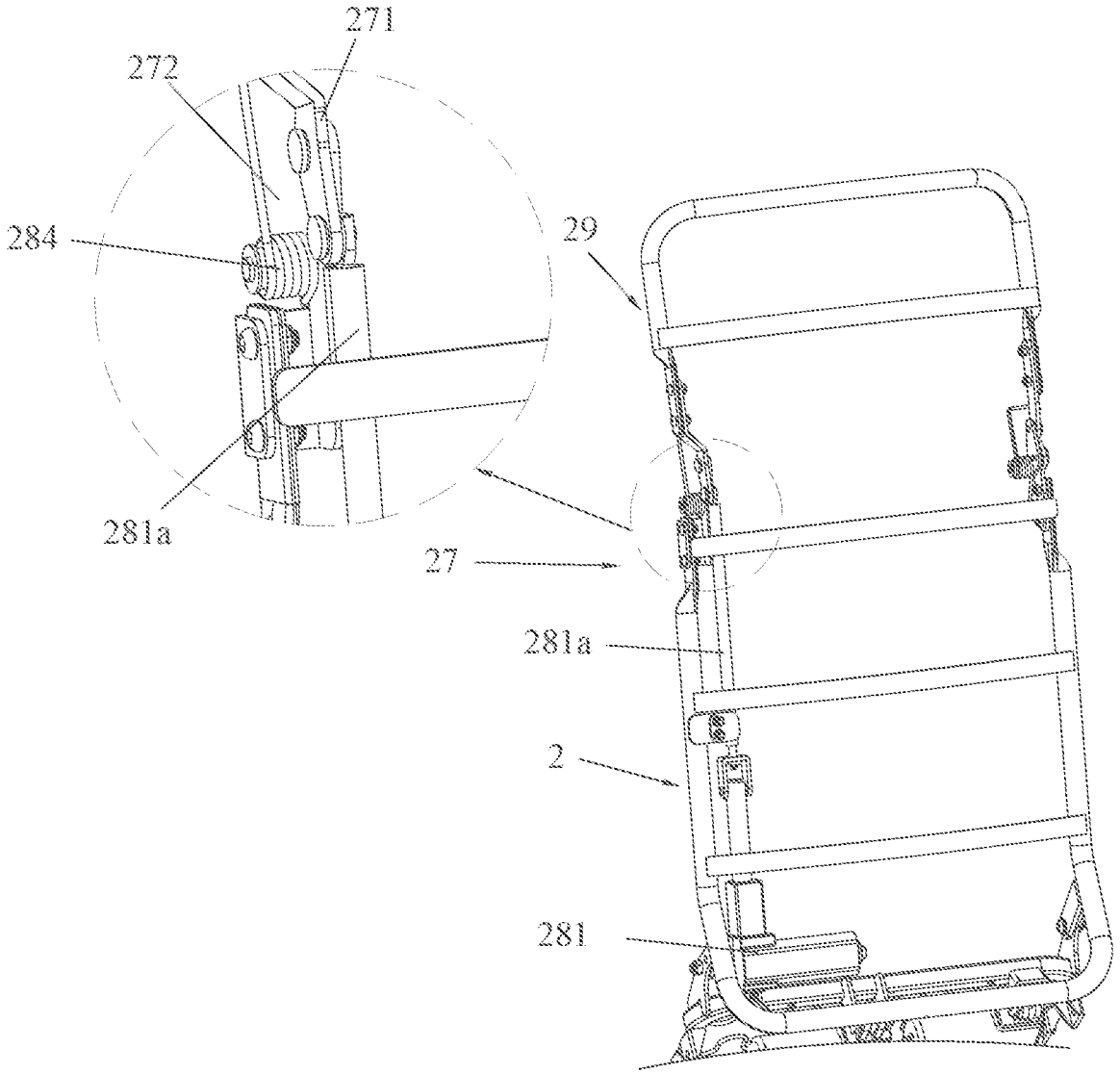
FIG. 9*b* is another partial perspective view and a partial enlarged view of the folding chair device according to the third embodiment of the present invention in the unfolded state, showing the backrest assembly, the headrest assembly and the headrest driving device.

As shown in FIGS. 9*a*-9*b*, as an embodiment, the headrest driving device 28 includes an electric push rod 281 and a linkage mechanism 27 mounted on the headrest assembly 29. When the linkage mechanism 27 is driven by the electric push rod 281, the headrest assembly 29 is rotated to change the angle of the headrest assembly 29, for example, from the unfolded state to the folded state, or other inclination angles to meet the needs of different users. Preferably, one end of the electric push rod 281 is pivotally connected (at the pivot point e) to the inner side of the lower end of the backrest assembly 2 (for example, the lower inner side of the U-shaped tube of the backrest assembly 2). As illustrated, the driving end 281*a* of the electric push rod 281 is extended substantially parallel to the two side tubes of the backrest assembly 2 and is connected with the linkage mechanism 27. In order to adapt to different product structures, the length of the driving end 281*a* of the electric push rod 281 can be extended by connecting an extension part.

Specifically, as shown in FIGS. 9*a*-9*b*, the linkage mechanism 27 includes a first hinge part 271 fixedly connected with the headrest assembly 29 and a second hinge part 272 pivotally connected with the backrest assembly 2, the first hinge part 271 and the second hinge part 272 are hinged together. More specifically, the driving end 281*a* of the electric push rod 281 is pivotally connected to one end of the first hinge part 271, the middle part of the first hinged part 271 is pivotally connected to one end of the second hinge part 272, the other end of the first hinge part 271 is fixed connected to the headrest assembly 29 (such as a supporting rod), and the other end of the second hinge part 272 is pivotally connected to the backrest assembly 2 (such as a fixing piece 24 on the supporting rod, as shown in FIG. 2*a*). When the driving end 281*a* of the electric push rod 281 pushes the first hinge part 271 upward, the first hinge part 271 and the connected second hinge part 272 are rotated around the corresponding hinge point, thereby driving the headrest assembly 29 to turn over, for example, to fold forward, in a folded position of the headrest, which is suitable for the folding posture of the folding chair. When the driving end 281*a* of the push rod 281 is retracted downward, the first hinge part 271 and the linked second hinge part 272 are rotated around the corresponding hinge points, thereby driving the headrest assembly 29 to turn over, for example, to turn backwards, into a position where the headrest is unfolded, which is suitable for the use posture of the folding chair.

As a preferred embodiment, in order to eliminate the gap existing in the hinged assembly and ensure the elastic stability between the components during the movement process, for example, during the headrest and the backrest are in a stable moving or holding state when the headrest position is adjusted, the headrest driving device 28 further includes a spring 284 connected between the first hinge part 271 and the second hinge part 272. Specifically, an end of the second hinge part 272 pivotally connected to the backrest assembly 2 is provided with a protruding portion (not labeled) for installing the spring 284, the spring 284 is sleeved on the protruding portion, and a first end of the spring 284 is connected to the first hinge part 271, and a second end of the spring 284 is connected to the second hinge part 272.

FIGS. 10-13 further show the specific structure of the folding chair device 300 of the present invention. Detailed descriptions for the related structures may be found in the first embodiment, which will not be repeated here.

It can be seen that the leg rest assembly 3, the backrest assembly 2, and the headrest assembly 29 of the folding chair device 300 in this embodiment can be automatically folded, and each folded assembly is independently controlled by its own driving device, therefore, the folding chair is multifunctional in different use occasions and is more humanized, and the structures are simple and the cost is low, which is suitable to promote in the market. Moreover, with their respective driving devices, the inclination angles of the leg rest assembly 3, the backrest assembly 2, and the headrest assembly 29 can be automatically adjusted according to actual needs, which is not limited to the two states of unfolding and folding.

Referring to FIG. 8 to FIG. 13, the working process of the folding chair device 300 of the present invention follows.

Figure 10:
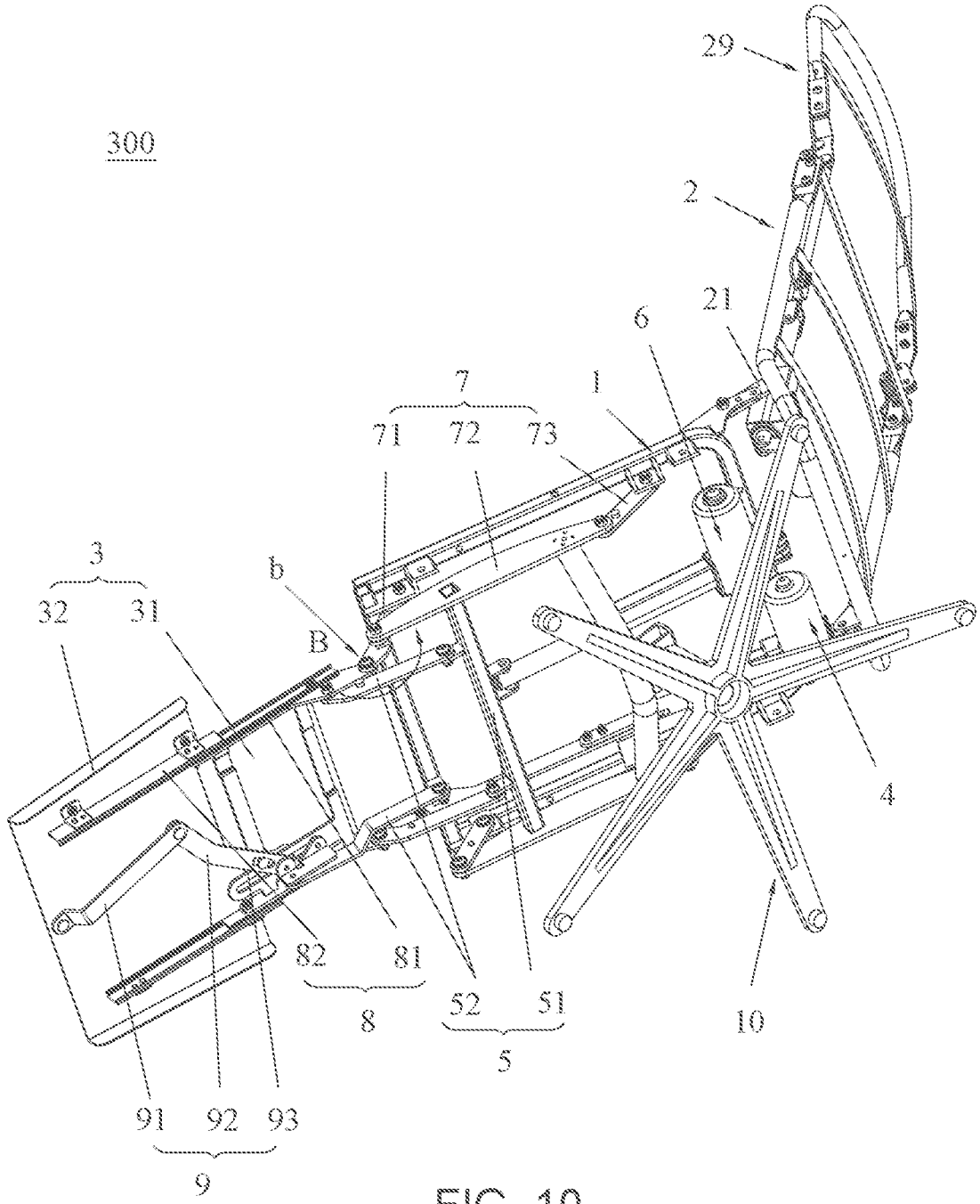
FIG. 10 is another perspective view of the folding chair device according to the third embodiment of the present invention in the unfolded state.
Figure 11:
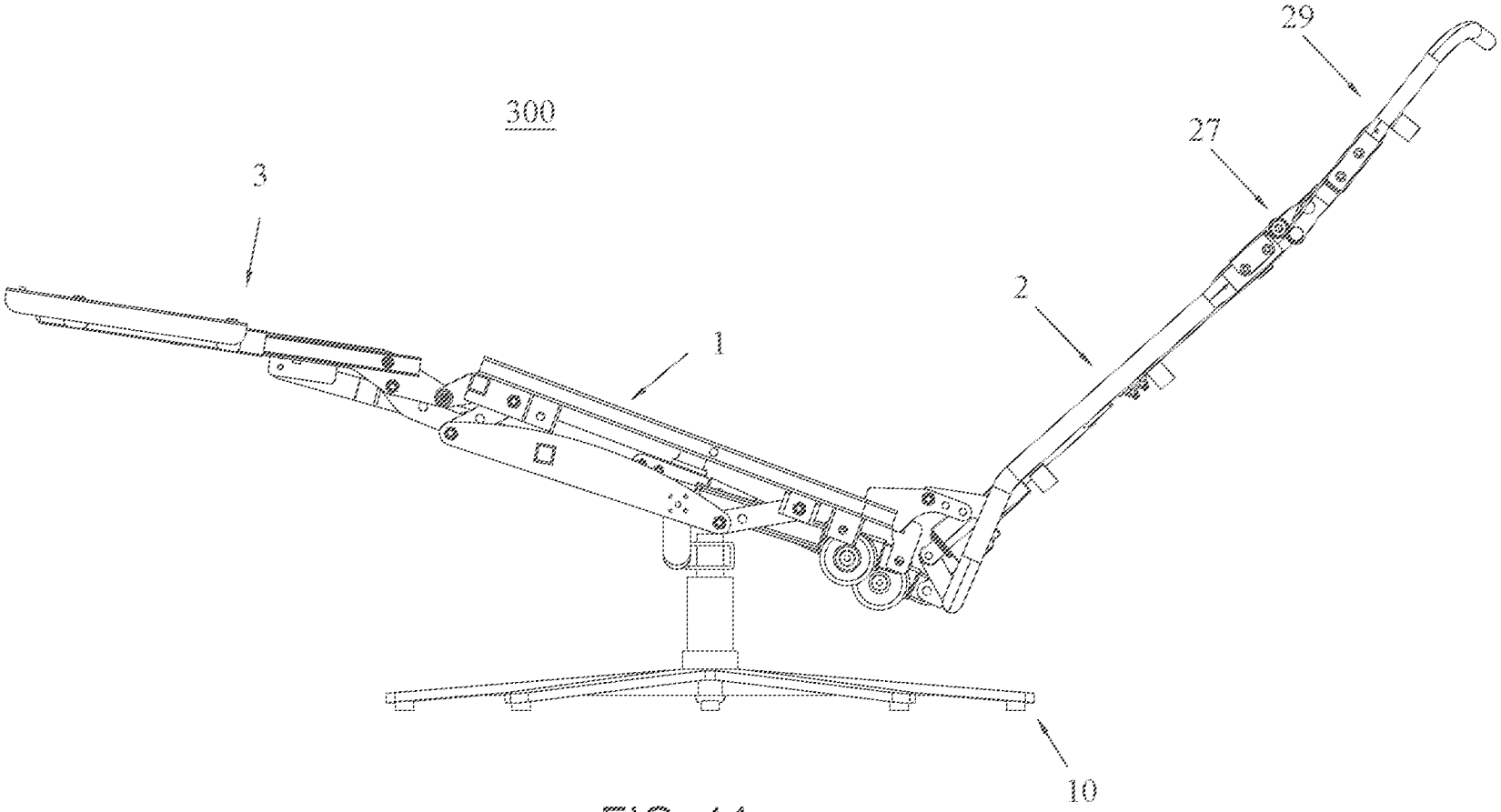
FIG. 11 is a side view of the folding chair device according to the third embodiment of the present invention in the unfolded state.
Figure 12:
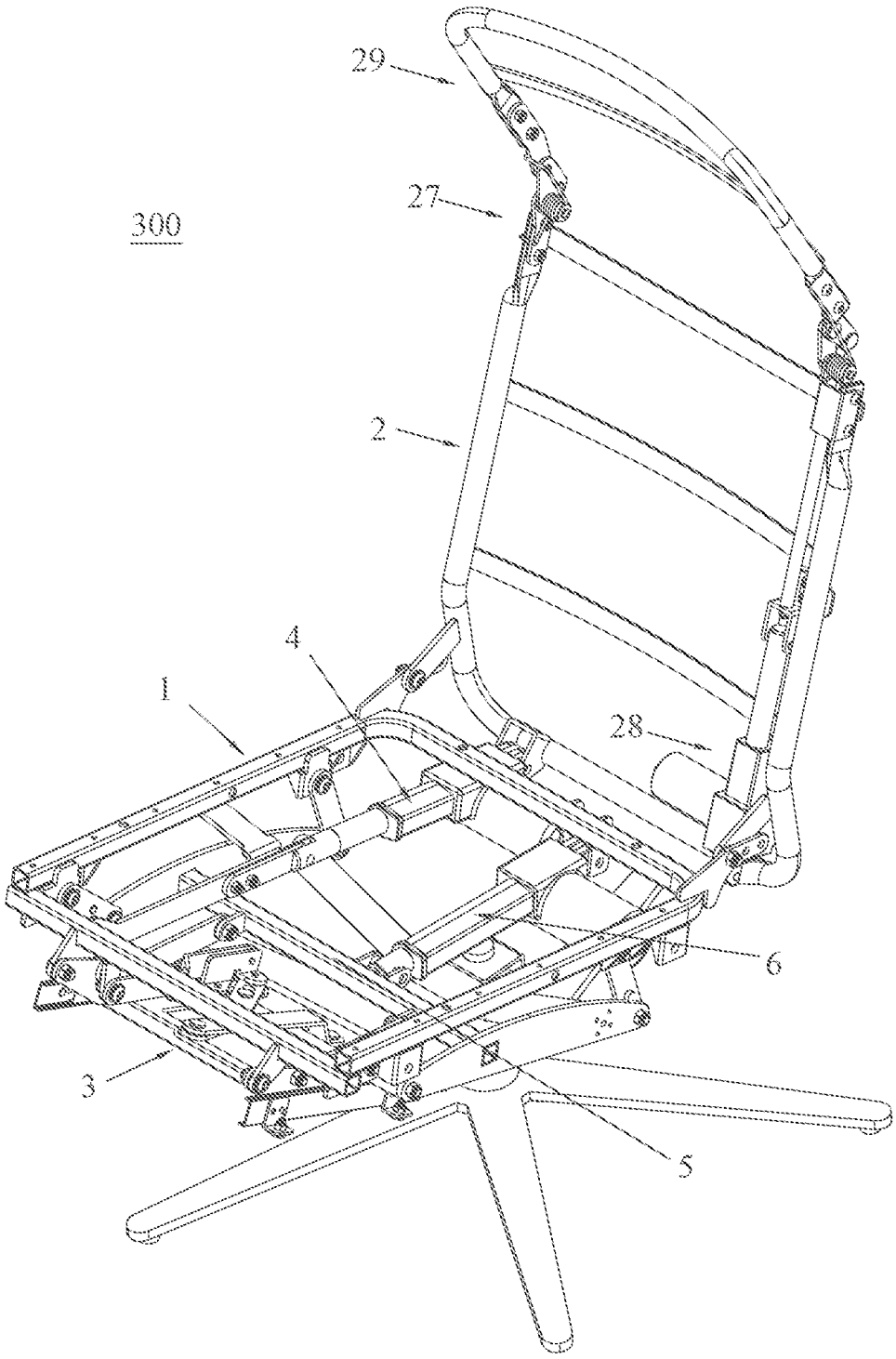
FIG. 12 is a perspective view of the folding chair device according to the third embodiment of the present invention in the folded state.
Figure 13:
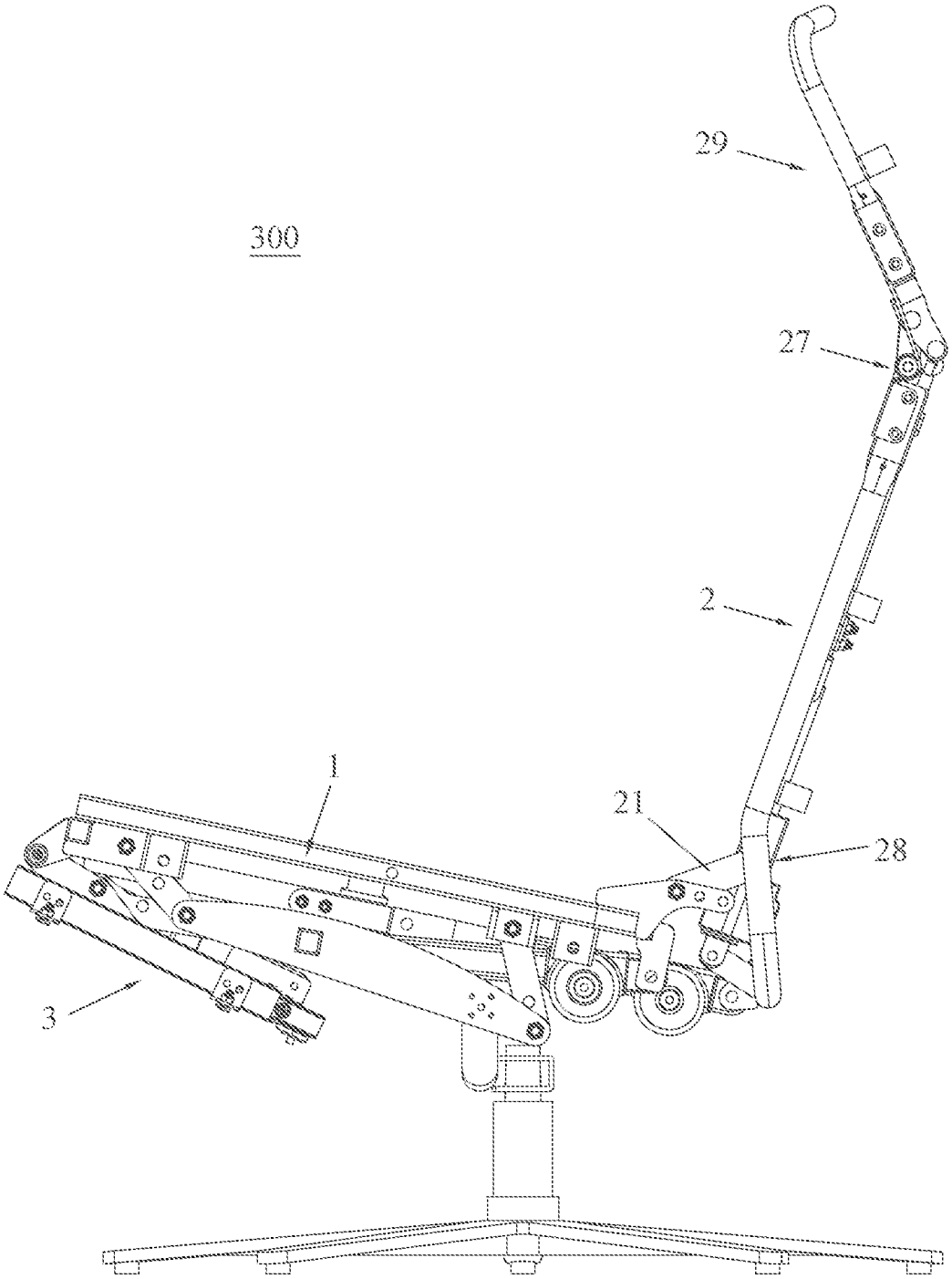
FIG. 13 is a side view of the folding chair device according to the third embodiment of the present invention in the folded state.

As shown in FIGS. 8, 10 and 11, the folding chair device 300 is in the unfolded state. When there is a need to fold, the driving end of the backrest driving device 4 is extended out, causing the backrest assembly 2 rotate around its pivot point a relative to the seat support assembly 1 (the rotation direction is indicated by arrow A in FIG. 8), so that the backrest assembly 2 is folded relative to the seat support assembly 1 to a certain degree. At the same time, the driving end of the leg rest driving device 6 is retracted. Since the driving crossbar 51, the first connecting rod 52, the leg rest assembly 3, the leg rest driving device 6 and the seat support assembly 1 together form the linkage mechanism, and a pivot point b is formed between the leg rest assembly 3 and the seat support assembly 1, thus the driving crossbar 51 moves along the direction indicated as arrow C in FIG. 8 and causes the first connecting rod 52 to drive the leg rest assembly 3 to pivot around its pivot point b relative to the seat support assembly 1 (the rotation direction is indicated by arrow B in FIG. 10), so that the leg rest assembly 3 can be folded, as shown in FIGS. 12 and 13. The movable frame 32 moves relative to the fixed frame 31 through the guide rail assembly 8, so that the leg rest assembly 3 can be extended or retracted. By means of the electric push rod 281 of the headrest driving device 28, the first hinge part 271 of the headrest assembly 29 is pushed upward, so that the first hinge part 271 and the connected second hinge part 272 are rotated around the corresponding hinge point, thereby driving the headrest assembly 29 to turn over, for example, to fold forward (the rotation direction is indicated by arrow D in FIG. 8), thereby adjusting the inclination angle of the headrest relative to the backrest assembly 2, as shown in FIGS. 12 and 13. When there is a need to unfold the device 300, the above actions are to be operated in reverse.

The above-mentioned embodiments only represent several embodiments of the present application, and the descriptions thereof are relatively specific and detailed, but should not be construed as limiting the scope of the patent application. It should be pointed out that for those skilled in the art, several modifications and improvements can be made without departing from the concept of the present application, which all belong to the protection scope of the present application. Therefore, the scope of protection of the patent of the present application shall be subject to the appended claims.

What is claimed is:

1. A folding chair device, comprising a seat support assembly, a backrest assembly, a leg rest assembly, a backrest driving device, a connecting rod assembly and a leg rest driving device, wherein a bottom of the backrest assembly is pivotally connected with the seat support assembly, the backrest driving device is configured between the seat support assembly and the backrest assembly, the backrest driving device is pivotally connected with the backrest assembly, and the backrest driving device is driven to pivot relative to the seat support assembly under a driving motion of the backrest driving device thereby adjusting an inclination angle of the backrest assembly; the leg rest assembly is pivotally connected with the seat support assembly, the leg rest driving device is mounted on the seat support assembly, and the connecting rod assembly is connected with a driving end of the leg rest driving device and pivotally connected with the leg rest assembly, and the connecting rod assembly is driven to actuate the leg rest assembly to pivot relative to the seat support assembly under a driving motion of the leg rest driving device thereby adjusting an inclination angle of the leg rest assembly;

wherein the connecting rod assembly comprises a driving crossbar and a first connecting rod, the driving crossbar is pivotally connected with the driving end of the leg rest driving device, one end of the first connecting rod is pivotally connected with the driving crossbar, the other end of the first connecting rod is pivotally connected with the leg rest assembly, and the driving crossbar moves relative to the seat support assembly under a driving motion of the leg rest driving device and causes the first connecting rod to drive the leg rest assembly to swing.

2. The folding chair device as claimed in claim 1, wherein a lower part of the backrest assembly is extended toward the seat support assembly to form a first connecting member, a bottom of the backrest assembly is extended toward the backrest driving device to form a second connecting member, and a driving end of the backrest driving device is connected to the seat support assembly, a head of the backrest driving device is pivotally connected to the second connecting member, and the first connecting member is pivotally connected to the seat support assembly.

3. The folding chair device as claimed in claim 2, wherein the seat support assembly is extended toward the backrest driving device to form an installation frame, the installation frame comprises an installation crossbar and an installation horizontal rod perpendicular to the installation crossbar, one end of the installation crossbar is connected to the seat support assembly, and the other end of the installation crossbar is connected with one end of the installation vertical rod, the other end of the installation vertical rod is connected with the seat support assembly, and the driving end of the backrest driving device is connected with the installation vertical rod.

4. The folding chair device as claimed in claim 1, further comprising a guide assembly including a first swing rod, a moving rod and a second swing rod, one end of the first swing rod is pivotally connected to the seat support assembly, and the other end of the first swing rod is pivotally connected to one end of the moving rod, the other end of the moving rod is pivotally connected to one end of the second swing rod, the other end of the second swing rod is pivotally connected to the seat support assembly, and the first swing rod, the moving rod, the second swing rod and the seat support assembly together form a four-bar linkage mechanism, the driving crossbar is connected with the moving rod, and the driving crossbar is movable relative to the seat support assembly to cause to unfold or fold the four-bar linkage mechanism.

5. The folding chair device as claimed in claim 4, wherein both sides of the driving crossbar are connected with one said four-bar linkage mechanism.

6. The folding chair device as claimed in claim 1, wherein the leg rest assembly comprises a fixed frame and a movable frame, the fixed frame is pivotally connected to the seat support assembly, the movable frame is slidably configured on the fixed frame, and the movable frame is movable relative to the fixed frame so as to unfold or fold the leg rest assembly.

7. The folding chair device as claimed in claim 6, wherein the leg rest assembly further comprises a sliding locking mechanism including a first pivoting rod, a second pivoting rod and a locking member, one end of the first pivoting rod is pivotally connected with the movable frame, one end of the second pivoting rod is pivotally connected with the other end of the first pivoting rod, and the other end of the second pivoting rod is connected with the locking member, and a pivoting motion between the first pivoting rod and the second pivoting rod is locked by the locking member.

8. The folding chair device as claimed in claim 6, wherein the leg rest assembly further includes a guide rail configured between the fixed frame and the movable frame.

9. The folding chair device as claimed in claim 1, further comprising a headrest assembly pivotally connected with the backrest assembly and having an adjustable inclination angle relative to the backrest assembly.

10. The folding chair device as claimed in claim 9, further comprising a hinge arranged between the headrest assembly and the backrest assembly, wherein the hinge includes a first hinge part and a second hinge part that are pivotally connected to each other, and the first hinge part is connected with the headrest assembly, the second hinge part is connected with the backrest assembly, and an inclination angle of the headrest assembly relative to the backrest assembly is adjustable by manually operating the hinge.

11. The folding chair device as claimed in claim 9, further comprising a headrest driving device, wherein a driving end of the headrest driving device is connected with the headrest assembly, and the headrest assembly is driven to rotate relative to the backrest assembly due to an automatic driving motion of the headrest driving device.

12. The folding chair device as claimed in claim 11, wherein the headrest driving device comprises an electric push rod and a linkage mechanism connected with the electric push rod.

13. The folding chair device as claimed in claim 12, wherein the linkage mechanism comprises a first hinge part fixedly connected with the headrest assembly and a second hinge part pivotally connected with the backrest assembly, the first hinge part and the second hinge part are hinged together, and a driving end of the electric push rod is pivotally connected to the first hinge part.

14. The folding chair device as claimed in claim 11, wherein the other end of the electric push rod is pivotally connected to the backrest assembly.

15. The folding chair device as claimed in claim 13, wherein the headrest driving device further comprises a spring connected between the first hinge part and the second hinge part.

16. The folding chair device as claimed in claim 15, wherein an end of the second hinge part pivotally connected to the backrest assembly is provided with a protruding portion for installing the spring, the spring is sleeved on the protruding portion, and a first end of the spring is connected to the first hinge part, and a second end of the spring is connected to the second hinge part.

17. The folding chair device as claimed in claim 12, wherein the electric push rod is mounted at a lower end of the backrest assembly, and a driving end of the electric push rod is mounted at one inner side of the headrest assembly.

* * * * *